US010069216B2

(12) United States Patent
Unterhalt et al.

(10) Patent No.: US 10,069,216 B2
(45) Date of Patent: Sep. 4, 2018

(54) GROUNDING DEVICE FOR A BATTERY OF A VEHICLE

(71) Applicants: Hella KGaA Hueck & Co., Lippstadt (DE); Intercable GmbH, Bruneck (IT)

(72) Inventors: Marco Unterhalt, Salzkotten (DE); Waldemar Ziebarth, Frondenberg (DE)

(73) Assignees: Intercable GmbH, Bruneck (IT); Hella KGaA Hueck & Co., Lippstadt (DE); Bayrische Motorenwerke Aktiengesellschaft (BMW), Munich (DE)

( * ) Notice: Subject to any disclaimer, the term of this patent is extended or adjusted under 35 U.S.C. 154(b) by 0 days.

(21) Appl. No.: 14/138,172

(22) Filed: Dec. 23, 2013

(65) Prior Publication Data

US 2014/0227917 A1 Aug. 14, 2014

(30) Foreign Application Priority Data

Dec. 27, 2012 (DE) ..... 10 2012 113 123

(51) Int. Cl.
*H01R 4/16* (2006.01)
*H01R 4/18* (2006.01)
(Continued)

(52) U.S. Cl.
CPC ..... *H01R 4/16* (2013.01); *H01R 4/185* (2013.01); *H01R 4/646* (2013.01); *H01R 43/16* (2013.01);
(Continued)

(58) Field of Classification Search
CPC ..... H01R 11/00; H01R 11/05; H01R 11/12; H01R 11/287; H01R 11/281;
(Continued)

(56) References Cited

U.S. PATENT DOCUMENTS 4,976,627 A * 12/1990 O'Loughlin ..... H02G 3/285 174/71 R
5,221,219 A * 6/1993 Thomson ..... H01R 11/281 29/857
(Continued)

FOREIGN PATENT DOCUMENTS

CN 2310395 3/1999
CN 201708302 U 1/2011
(Continued)

OTHER PUBLICATIONS

Chinese Patent Office, First Office Action of Feb. 27, 2017 of related application 2013-10737436.4 including translation.
(Continued)

*Primary Examiner* — Edwin A. Leon
*Assistant Examiner* — Oscar Jimenez
(74) *Attorney, Agent, or Firm* — Agris & Von Natzmer, LLP; Joyce Von Natzmer

(57) ABSTRACT

The invention relates to a grounding device (10) for a battery (100) of a vehicle, comprising a connection section (20) for connecting electric wiring (110) to the battery (100), a grounding section (30) for connecting to a ground (120) of the vehicle, and a contact section (40) for connecting to an external power source, characterized in that the contact section (40) is embodied at least sectionally by way of folding over the material of the grounding device (10).

20 Claims, 2 Drawing Sheets

(51) Int. Cl.
*H01R 4/64* (2006.01)
*H01R 43/16* (2006.01)

(52) U.S. Cl.
CPC ..... *H01R 2201/26* (2013.01); *Y10T 29/49156* (2015.01)

(58) Field of Classification Search
CPC .... H01R 11/283; H01R 11/288; H01R 43/16; H01R 14/185; H01R 2201/26; H01R 2103/00; H01R 31/06
USPC ..... 29/863, 731, 246; 438/108, 386, 504, 438/522, 388, 801, 758, 727, 775, 762, 438/883, 884, 888–891, 92, 34, 754, 763, 438/907; 174/78, 84; 439/108, 386, 504, 439/522, 388, 801, 758, 727, 775, 762, 439/883, 884, 888–891, 92, 34, 754, 763, 439/907
See application file for complete search history.

(56) References Cited

U.S. PATENT DOCUMENTS 5,733,152 A * 3/1998 Freitag ..... H01R 11/281 439/762
7,081,589 B1 * 7/2006 Advey et al. ..... 174/78
2002/0153860 A1 * 10/2002 Liang ..... H02K 17/22 318/727
2006/0211281 A1 * 9/2006 Machado ..... H01R 4/2425 439/92
2007/0254504 A1 * 11/2007 Machadu ..... H01R 4/2425 439/92
2008/0194126 A1 * 8/2008 Grant et al. ..... 439/108
2010/0197179 A1 * 8/2010 Miyamoto ..... H01R 4/646 439/877
2011/0039458 A1 2/2011 Byrne
2011/0143595 A1 * 6/2011 Facco ..... H01R 11/282 439/625

FOREIGN PATENT DOCUMENTS

CN 202333194 U 7/2012
DE 19837314 A1 3/2000
DE 102007010091 A1 9/2008
DE 102012000434 A1 8/2012
DE 102012001147 A1 8/2012
DE 102012015350 A1 2/2014
EP 1605548 A1 12/2005
JP 06076867 A 3/1994
JP 2010123291 A 6/2010

OTHER PUBLICATIONS

German Search Report for corresponding application DE 10 2012 113 123.6; Report dated May 13, 2015.

* cited by examiner

GROUNDING DEVICE FOR A BATTERY OF A VEHICLE

TECHNICAL FIELD

The present invention relates to a grounding device for a battery of a vehicle as well as a method for producing a grounding device for a battery of a vehicle.

BACKGROUND

Grounding devices for batteries of vehicles are known in general. They are used in vehicles in order to connect the vehicle battery to an appropriate ground connector, thus to ground the vehicle. For this purpose vehicles are frequently equipped with pins welded to the body, at which via a grounding connection such a grounding device is mounted. Additionally, such grounding devices frequently comprise a connection section, which serves to connect electric wiring to the battery. This wiring is particularly guided to a terminal of the battery. It is also known that grounding devices show a contact section for the connection of an external power source. This is the case, for example, when the battery shall be charged via an external power source and/or an external power generator. In order to allow providing an easily accessible position as an alternative to clamping the external power generator to individual terminals of the battery, such contact connections are formed as a part of the grounding device. In grounding devices of prior art this contact connection is ensured by a contact pin, which is pressed into a corresponding opening in the grounding device.

Grounding devices of prior art show the disadvantage that the production of the contact section is expensive, costly, and time consuming. For example, a separate processing step is required for pressing in the contact pin, and a separate machine must be provided. Furthermore, by impressing a contact pin frequently here a pairing of materials and/or a multi-part design of the grounding device is tolerated. This leads to the effect that a transition resistance may develop between different materials of the grounding device, thus between the base material of the grounding device and the material of the contact section. When different materials are used for the contact pin and the remaining material of the grounding device here undesired aging symptoms may develop, which during use increase the transition resistance over time. Furthermore, in such multi-part embodiments of prior art different electric conductance values are given, so that additionally a worsening occurs for the use of a grounding device of prior art.

BRIEF SUMMARY

The invention seeks to at least partially correct the above-described disadvantages of grounding devices of prior art. In particular, the invention provides a grounding device for a battery of a vehicle as well as a method for producing a grounding device for a battery of a vehicle, allowing a cost-effective and simple production, particularly with improved conditions for use.

Here, features and details described in the context with the grounding device according to the invention are also applicable in the context with the method according to the invention and vice versa, of course, so that with regards to the disclosure alternating reference is made and can always be made to the individual aspects of the invention.

The grounding device according to the invention for a battery of a vehicle comprises a connection section for connecting electric wiring to the battery. Further, a grounding section is provided to be connected to a ground of the vehicle. Furthermore, a contact section is provided for contacting an external power source. The grounding device according to the invention is characterized in that the contact section is embodied at least sectionally by the material of the grounding device being folded over.

In one grounding device according to the invention a connection section is preferably formed as a crimped section. This means that by way of bending the connection section a mechanically fastened contact can be formed to electric wiring to the battery, particularly in a form-fitting fashion. Preferably an opening is provided as the grounding section, which allows the grounding device to be pushed over a pin welded to the vehicle body. Here, fixing means may also be useful, which e.g. with the help of a cap nut allow a fixation of the grounding device at the ground of the vehicle.

The contact section is preferably embodied for a connection to an external power source in order to charge the battery. Within the scope of the invention it is also possible to provide for an adjustment to the external power supply when the vehicle shall be started by an external power source, when the battery is discharged.

Based on the fact that in grounding devices according to the invention the contact section is at least sectionally embodied by the material of the grounding device being folded over, additional processing steps, particularly the impression of a separate contact pin, can be omitted. Due to the fact that here additional sections of the grounding device, particularly the grounding section and/or the connection section, are produced by bending the material of the grounding device an additional bending step can be performed in a preferred joint processing step to embody the contact section, particularly using the same machine. This way an additional production machine in the form of an press-fit machine can be waived. Furthermore, an additional step of impressing can be avoided here, for which an additional alignment of the grounding device would be necessary in order to perform said step.

The grounding device according to the invention preferably represents a component made from sheet metal. For example, electrically conductive sheets may be used, such as copper or copper alloys.

The contact section can be used in a grounding device according to the invention, for example to access an external power source, in order to jump-start the vehicle when the battery is dead. In the sense of the present invention the terms external power supply and external generator are used as synonyms. Thus, a clamp, a clip, or a plier-like device may be provided at the contact section in order to create an electrically conductive connection to the external power source. Additionally, during the production of the vehicle and/or the final assembly the battery of the vehicle can be charged via such a contact section. Preferably, the entire grounding device according to the present invention is produced integrally from a single material.

For example, the production steps may be performed as described in the following. In a first step the grounding device is cut out, preferably punched out. Subsequently the basic form provided by this production step is finalized by one or more bending steps performed in a bending machine. Here, the individual sections, particularly the connection section and/or the contact section and/or the grounding section are bent appropriately. In particular the contact section is partially folded over. The folding over occurs in a manner such that either a circular or elliptic embodiment of the contact section develops or that an enlarged thickness of the contact section develops by folding over the material and thus doubling the material thickness.

It may be advantageous when in a grounding device according to the invention the contact section is embodied such that by folding over the material an inner section within the contact section is formed, which is open to two sides. This way the contact surface of the contact section is further enlarged without here any additional filling material being required. Furthermore, the production is facilitated here, because a flattening compression is no longer mandatory. For example, the bending can occur by a rolling fashion of folding over so that a kind of rolling mandrel is used around which the material is folded over by holding the material of a grounding device. In other words, preferably a contact section is provided, which shows a material wrap in the form of a cylindrical sleeve area.

It may be advantageous if in a grounding device according to the invention the contact section is embodied round or essentially round, at least sectionally. Here, an embodiment with an essentially round cross-section shall preferably also be understood as a cross-section, which is embodied elliptically. This way any optional connecting and/or contacting of an external power source is further simplified. In particular when using clamps, clips, or plier-like devices any contacting of the contact section can occur in an even easier fashion and especially with a secure, mechanic fastening. Last but not least by a round and/or essentially round embodiment of the contact section a particularly homogenous surface is provided, so that here a good contact to the external power source and an correspondingly good electric power transfer is provided between the external power source and the contact section. By the rolling folding over and the round and/or essentially round embodiment of the contact section here the reinforcement by the cold deformation during the folding process is altered such that predetermined breaking points caused by the cold deformation of the material are essentially avoided. This leads to a higher mechanic stability of the grounding device overall and the contact section in particular.

Another advantage is achieved here such that in the grounding device according to the invention the contact section is produced in one piece, particularly integrally, with at least one other section, particularly with all other sections of the grounding device. In particular, the grounding device is produced from sheet metal, provided in the form of plates. This way, the basic form of the grounding device can be produced by simple cutting it out. Subsequently, the contact section and particularly also the other sections are produced by bending and/or by an appropriate folding over in a bending machine. By the integral and/or one-piece embodiment from a single material here a better conductance value can be achieved for the entire device. Furthermore, costs are reduced during the production, because no other materials need to be used. Additionally, aging problems with an increase of the transition resistance between different components, particularly comprising different materials, is avoided in such an embodiment.

It is also advantageous that in a grounding device according to the invention at least the contact section, particularly all contact sections of the grounding device, are made from a copper alloy. Here, e.g. brass or a brass-like material may be used as the copper alloy. Preferably the sheet metal comprises a copper alloy. This way, in a cost-effective and simple fashion high electric conductivity can be ensured so that in particular a grounding device equipped with high functionality can be produced in a particularly cost-effective fashion.

It is further advantageous when in a grounding device according to the invention the contact section is embodied by a two-sided folding of the material of the grounding device such that the ends of the material folded over are located opposite each other, particularly contacting each other. In other words, a two-sided folding of the material occurs by essentially 180°, so that preferably in a symmetric fashion an opposite positioning of the two ends occurs of the material folded over. Thus, a butt seam develops between the two ends folded over. They preferably touch each other in order to allow a particularly efficient contacting to the external power generator. Furthermore, when the ends of the material folded over contact each other here a post-processing after the pending process can be avoided, because the sharp ends of the material folded over, accordingly prone to cause injuries, secure each other by way of contacting.

It is also advantageous when in a grounding device according to the invention the contact section is angular, particularly showing an angle ranging from approximately 0° to approximately 60°, in reference to a base plate of the grounding device. The angular arrangement leads to a facilitated access to the contact section. When a clamp or clamp-like device is used for the external power source this may provide a facilitated access with an easier contacting. Depending on the intended position of the grounding device in the vehicle by an angular alignment of the contact section here a facilitated access to the respective vehicle may be adjusted.

The invention further provides a method for the production of a grounding device for a battery of a vehicle, comprising a connection section for connecting electric wiring to the battery, a grounding section for the connection to a ground of the vehicle, and a contact section for the connection to an external power source, comprising the following steps:

Cutting a base form for the grounding device,

Embodying at least one contact section by at least sectionally folding over the material of the base form of the grounding device.

The cutting of the grounding device can be provided e.g. by a classic cutting of the sheet metal or by way of punching in a punch. Additionally, modern cutting methods, such as laser cutting or water jet cutting are possible within the scope of the present invention. Of course, after cutting a step of beveling may be performed in order to minimize the risk for injuries when handling the basic form and the final grounding device. Preferably all sections of the basic form are produced in a single step by way of punching so that the costs arising for the production can be reduced even further. Preferably all sections are subsequently produced by way of bending so that a single bending step and/or separately bending steps performed successively in a single bending machine ultimately result in a grounding device according to the invention. The basic form of this grounding devices is particularly a semi-finished product, which is further processed by the above-mentioned bending steps.

The method according to the invention can here be further developed such that during the embodying of the contact sections first the folding over of the material occurs and then an angular abutting of the material folded over. This bending and angular abutting after the embodiment of the contact section leads to a grounding device, which can be contacted in an improved manner. Of course, a final alignment of the contact section is also possible in a manner according to the invention.

It is advantageous when a method according to the invention is used in order to produce a grounding device according to the invention. This way, a method according to the invention results in the same advantages as explained in detail with reference to the grounding device according to the invention.

BRIEF DESCRIPTION OF THE DRAWINGS

The present invention is explained in greater detail based on the attached figures of the drawing. Here it shows schematically.

DETAILED DESCRIPTION

Figure 2:
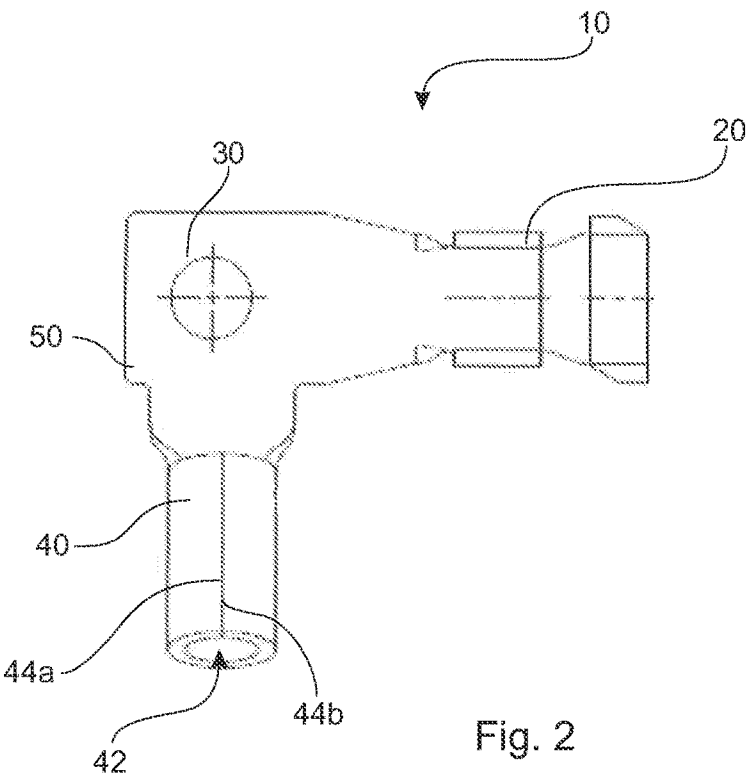
Figure 1:
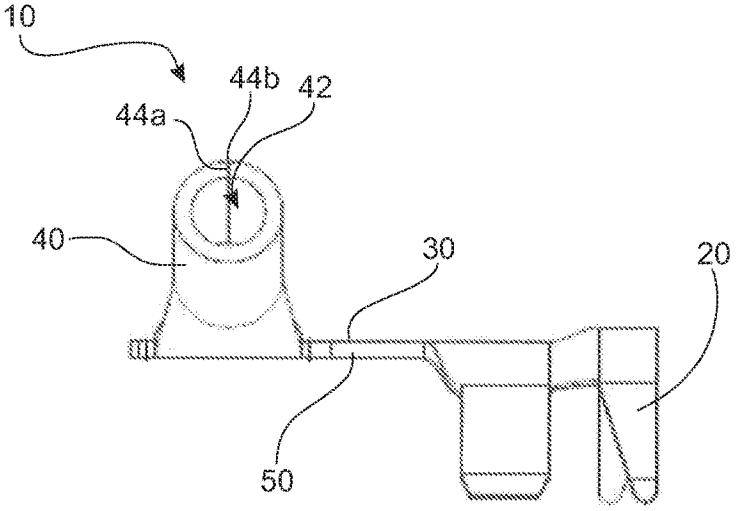
FIG. 1 a first embodiment of a grounding device according to the invention in a side view, FIG. 2 the embodiment according to FIG. 1 in a top view, FIG. 3 another embodiment of a grounding device according to the invention in a cross-section of a detail, and FIG. 4 the embodiment of FIG. 3 in an assembled state.

FIGS. 1 and 2 show a first embodiment of a grounding device 10 according to the invention. It is essentially produced from a sheet metal, particularly comprising a copper alloy. The base plate 50 shows various connected sections 20, 30, and 40. For example a connection section 20 is provided, which is embodied like a bar and is provided for the crimped connection to electric wiring. Furthermore, a grounding section 30 is provided, which shows a round opening. This round opening can be pushed over a ground 120 at the body of a vehicle such that an assembly of the grounding device 10 to such a ground 120 of the vehicle is possible.

In this embodiment of the grounding device 10 additionally a contact section 40 is provided in an inventive fashion. As discernible from FIGS. 1 and 2, this contact section is produced by way of folding over the material of the grounding device 10. Here, the abutting two ends 44*a* and 44*b* of the material folded over are discernible. The folding over has been performed in such a fashion that an interior cavity with an essentially round cross-section has been provided as the interior section 42. This way, the contact section 40 can also be called the embodiment of a cylindrical sleeve area and/or a hollow cylinder.

For producing this dual, particularly symmetric fold preferably a bending mandrel has been placed on the material of the grounding device 10 such that subsequently a folding occurs at both sides about this bending mandrel. Here, the two ends 44*a* and 44*b* preferably abut in a contacting fashion.

Figure 3:
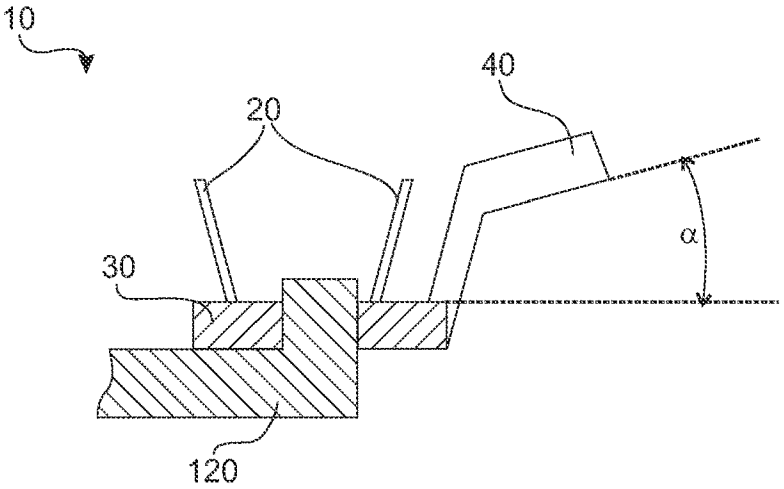

FIG. 3 shows an assembled situation of a grounding device 10 according to the invention. Here, a grounding device 10 according to the invention was mounted over a ground 120 of a vehicle body with the help of the grounding section 30. A connection section 20 is clearly discernible, which is shown in the un-crimped state. Also easily discernible is the contact section 40, which is here shown with an angle $\alpha$ ranging from 0 to 60°.

Figure 4:
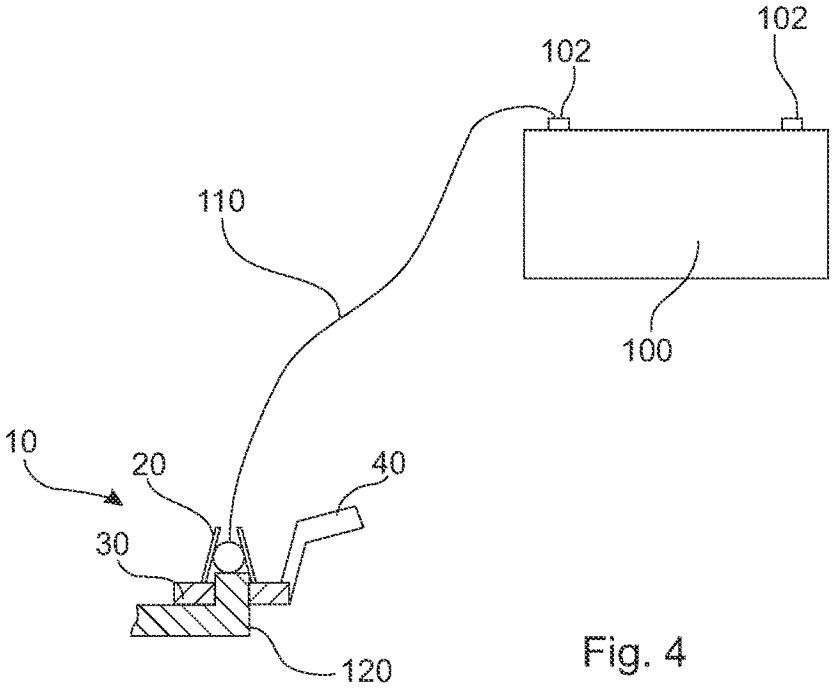

FIG. 4 shows the embodiment of FIG. 3 in the assembled state. Here, the electric wiring 110 is clearly discernible, which now in the crimped state is connected to the connection section 20 of the grounding device 10. At the other end of the electric wiring 110 it is connected to a terminal 102 of the battery 100.

The above-stated explanations of the embodiments describe the present invention only within the scope of examples. Of course, individual features of the embodiments, to the extent technically useful, may be arbitrarily combined with each other without leaving the scope of the present invention.

The invention claimed is:

1. A grounding device for a battery of a vehicle, comprising:

a connection section adapted to connect the grounding device to the battery via electric wiring, and, perpendicular thereto, a contact section comprising a first end and a second end and being adapted to connect the grounding device, via the second end, to an external power source, and a grounding section adapted to connect the grounding device to a ground of the vehicle and connected to the connection section and the first end of the contact section, wherein the contact section comprises at least over a section at the second end a cylindrical sleeve area in form of a material wrap, the material being material of the grounding device, wherein, when in use, the connection section connects the grounding device to the battery via the electrical wiring, the grounding section connects the grounding device to the ground of the vehicle and the contact section connects the grounding device to the external power source.

2. The grounding device according to claim 1, wherein the contact section is designed such that by folding over the material a section is formed inside the contact section which is open to two sides.

3. The grounding device of claim 2, wherein the contact section is designed as one piece and wherein the ends of the material folded over are located opposite each other.

4. The grounding device of claim 3, wherein the ends abut each other.

5. The grounding device according to claim 1, wherein the cylindrical sleeve area is round or essentially round.

6. The grounding device according to claim 1, wherein the contact section is designed as one piece.

7. The grounding device according to claim 6, wherein all sections of the grounding device are provided integrally in the one piece.

8. The grounding device according to claim 1, wherein at least the contact section is made from copper alloy.

9. The grounding device according to claim 1, wherein the contact section is formed by a two-sided folding over of the material of the grounding device such that the ends of the material folded over are located opposite each other.

10. The grounding device according to claim 9, wherein the ends facing each other abut.

11. The grounding device according to claim 1, wherein the contact section is perpendicular to the connection section in reference to a base plate of the grounding device.

12. The grounding device according to claim 1, wherein a right angle is part of the unbent shape of the grounding section.

13. The grounding device of claim 1, wherein the contact section is formed by a two-sided folding over of the material of the grounding device such that the ends of the material folded over are located opposite each other, and wherein a right angle is part of a unbent shape of the grounding section.

14. The grounding device of claim 1, wherein the grounding section is integrally connected to the first end of the contact section.

15. A method for producing a grounding device for a battery of a vehicle, comprising;

a connection section adapted to connect the grounding device to the battery via electrical wiring, a grounding section adapted to connect the grounding device to a ground of the vehicle and connected to the connection section and a first end of a contact section, and the contact section comprising the first end and a second end and being adapted to connect the grounding device to an external power source, wherein the contact section comprises, at least over a section at the second end, a cylindrical sleeve area in form of a material wrap, the method comprising:

cutting a basic form of the grounding device so that the connection section is perpendicular to the contact section, and designing at least the contact section by at least folding over material of a basic form of the grounding device to produce at least over the section at the second end, the cylindrical sleeve area in form of the material wrap, wherein, when in use, the connection section connects the grounding device to the battery via the electrical wiring, the grounding section connects the grounding device to the ground of the vehicle and the contact section connects the grounding device to the external power source.

16. The method according to claim 15, wherein an angular contacting of the material folded over occurs.

17. The method according to claim 15, wherein the basic form of the grounding device is cut from one piece of sheet metal.

18. The method according to claim 15, wherein the contact section is cut from one piece together with the grounding section of the grounding device.

19. The method according to claim 18, wherein the contact section and grounding section are made of sheet metal.

20. The method according to claim 15, wherein the contact section is cut from one piece with all other sections of the grounding device, wherein the contact section and connection section are cut out perpendicular to each other.

* * * * *